US006918173B2

(12) United States Patent
Ahn

(10) Patent No.: US 6,918,173 B2
(45) Date of Patent: Jul. 19, 2005

(54) METHOD FOR FABRICATING SURFACE MOUNTABLE CHIP INDUCTOR

(75) Inventor: Byeung-Joon Ahn, Seoul (KR)

(73) Assignee: Ceratech Corporation (KR)

( * ) Notice: Subject to any disclaimer, the term of this patent is extended or adjusted under 35 U.S.C. 154(b) by 0 days.

(21) Appl. No.: 09/915,703

(22) Filed: Jul. 26, 2001

(65) Prior Publication Data

US 2002/0013994 A1 Feb. 7, 2002

(30) Foreign Application Priority Data

Jul. 31, 2000 (KR) ..... 2000/44252
Nov. 8, 2000 (KR) ..... 2000/66089
May 11, 2001 (KR) ..... 2001/25833

(51) Int. Cl.[7] ..... H01F 7/06; H01F 3/08

(52) U.S. Cl. ..... 29/602.1; 29/605; 29/608; 336/192; 336/233

(58) Field of Search ..... 29/602.1, 605, 29/608; 336/192, 212, 233; 228/164, 141.1, 165, 168, 169, 170

(56) References Cited

U.S. PATENT DOCUMENTS 4,490,706 A * 12/1984 Satou et al. ..... 336/192 X
6,070,787 A * 6/2000 Harada et al. ..... 228/164
6,076,253 A * 6/2000 Takayama et al. ..... 29/605
6,144,280 A * 11/2000 Amada et al. ..... 336/192
6,154,112 A * 11/2000 Aoba et al. ..... 336/192
6,189,204 B1 * 2/2001 Shikama et al. ..... 29/605
6,377,151 B1 * 4/2002 Takayama et al. ..... 336/192 X
6,393,691 B1 * 5/2002 Ogawa et al. ..... 29/602.1
2002/0151114 A1 * 10/2002 Kanetaka et al.

FOREIGN PATENT DOCUMENTS

JP 11-121234 4/1999
JP 11-154610 6/1999
JP 2000-036414 2/2000

OTHER PUBLICATIONS

Office Action issued by Japanese Patent Office on Jul 31, 2003 in prosecution of corresponding Jananese Patent Application No. 2001–231073 (untranslated).
English translation of Abstract for Japanese Patent No. 2000–036414.
English translation of Abstract for Japanese Patent No. 11–154610.
English translation of Abstract for Japanese Patent No. 11–121234.

* cited by examiner

*Primary Examiner*—Ljiljana Ciric
(74) *Attorney, Agent, or Firm*—Ostrolenk, Faber, Gerb & Soffen, LLP

(57) ABSTRACT

In a method for fabricating a surface mountable chip inductor, a spiral coil pattern is formed on a surface of a cylindrical body fabricated by mixing ferrite or ceramic powder with thermoplastic organic binder, the cylindrical body is transformed into a square-shaped body by being inserted into a square-shaped mold and pressure being applied at a certain temperature. An electric characteristic lowering problem can be prevented by forming the coil on the cylindrical body, and transforming the cylindrical body into a square-shaped body to improve surface mounting.

18 Claims, 7 Drawing Sheets

METHOD FOR FABRICATING SURFACE MOUNTABLE CHIP INDUCTOR

BACKGROUND OF THE INVENTION

1. Field of the Invention

The present invention relates to a method for manufacturing a chip inductor, and in particular to a method for manufacturing a surface mountable chip inductor used for electric appliances, etc.

2. Description of the Prior Art

A chip inductor is used for various electric appliances such as electronic home appliances as well electronic industrial equipment, etc. Recently, responsive to miniaturization and lightweight trends of various electric appliances, electric parts for electric appliances are also being miniaturized and rendered lighter. In the meantime, as a result of the development of digital communication, the frequency being used is gradually extended to a high frequency region, and accordingly, electromagnetic interference conditions have deteriorated. Most electronic devices are surface-mounted on a printed circuit board to automate fabrication processes. However, because the surface-mounted devices have a square shape, the conventional cylindrical inductor has difficulty in surface mounting.

An inductor is divided into a wire wound type and a stacked type, each having different application fields and fabrication methods.

In a wire wound type inductor, a coil is wound on a base body such as a magnetic material, etc. In this case, as the number of windings increases in order to get a high inductance, the high frequency characteristic deteriorates based on the increased number of windings, because a stray capacitance is present between the wound coils.

In the meantime, in a stacked type inductor, a base body is the same as the wire wound type inductor, but green sheets having internal electrodes printed as a spiral shape are stacked instead of a wound coil. Pressurization and sintering are performed on the stacked green sheets, and an external electrode is placed at both ends of the base body. The stacked type inductor is surface mounted on a circuit board and is used for noise elimination or impedance matching, etc., it is appropriate to for mass production and at the same time has an excellent high frequency characteristic by using Ag (silver) as an internal electrode. On the contrary, because the number of stacked green sheet is limited, there is a limitation on inductance, and particularly because a width of internal electrode is limited, there is a limitation in permitting sufficient current. Accordingly, it is inappropriate to use the stacked type inductor for power device, so its use is mainly limited for a low voltage and a low current. In addition, the fabrication process itself is very intricate and lots of equipment costs are required.

In order to solve above-mentioned problems, an inductor fabricated by forming a metal layer on a cylindrical body and forming a coil pattern on the metal layer by trimming of the metal layer has been presented, however surface mounting of the fabricated inductor is difficult because of its cylindrical shape. On the contrary, a square-shaped inductor is advantageous to surface mounting however a square-shaped inductor requires much time for trimming a metal layer on its surface using a laser, which causes fabrication costs to increase. In addition, variation in the quantity of laser light-interception prevents a pattern on the surface of the inductor from forming uniformly; accordingly its electric characteristic lowers.

SUMMARY OF THE INVENTION

Accordingly, it is an object of the present invention to provide a surface mountable chip inductor having a good electric characteristic.

In order to achieve above-mentioned object, a spiral pattern is formed at a surface of a cylindrical inductor main body in order to facilitate fabrication and improve an electric characteristic, and the cylindrical shape is transformed into a square shape in order to facilitate surface mounting.

In more detail, a method for fabricating a surface mountable chip inductor includes forming a cylindrical body by mixing thermoplastic organic binder with ferrite or ceramic powder, forming a coil pattern on a surface of the cylindrical body, inserting the cylindrical body having the coil pattern into a square-shaped mold, and transforming the cylindrical body into a square-shaped body by pressing it at a certain temperature.

BRIEF DESCRIPTION OF THE DRAWINGS

Wherein FIG. 6*a* illustrates a cylindrical body having a coated layer on the outer circumference;

FIG. 6*b* illustrates a cylindrical body inserted into a square-shaped mold;

FIG. 6*c* illustrates a transformed square-shaped body;

FIG. 6*d* illustrates cut single inductors;

FIGS. 7*a* to 7*c* are flow charts illustrating another process transforming a cylindrical body into a square-shaped body; wherein FIG. 7*a* illustrates a cylindrical body inserted into a square-shaped mold;

FIG. 7*b* illustrates a transformed square-shaped body;

FIG. 7*c* illustrates cut single inductors; and

DETAILED DESCRIPTION OF THE PREFERRED EXAMPLE EMBODIMENTS

First, as an inductor main body, ferrite or ceramic powder mixed with a thermoplastic organic binder is formed into a cylindrical shape by a process such as extruding or pressing.

A main body is formed so as to have a cylindrical shape and a coil pattern is formed at a surface of the main body. In a first example of the present invention, a metal layer is formed on a surface of the cylindrical body and a spiral coil pattern is formed on the metal layer.

In accordance with another example of the present invention, a coil pattern is formed by winding a thread-shaped flexible material including conductive paste on the surface of the cylindrical body and hardening the conductive paste included in the flexible material.

In accordance with a still another example of the present invention, a coil pattern is formed by winding a tape having a certain thickness and a width on the surface of the cylindrical body as a spiral shape having a certain interval, coating conductive paste between the wound tape, and hardening the coated conductive paste.

In accordance with a further example of the present invention, a coil pattern is formed by winding a flexible material free of conductive paste on the outer circumference of the cylindrical body with a certain interval, coating conductive paste on the outer circumference of the cylindrical body by dipping the cylindrical body in a container containing conductive paste, and hardening the coated conductive paste for a given time.

The cylindrical body is transformed into a square-shaped body by inserting the cylindrical body having the coil pattern into a square-shaped mold and applying pressure on it at a certain temperature. Accordingly, the resulting chip inductor not only has a good electric characteristic but also is advantageous to surface mounting.

Hereinafter, the method for fabricating a surface mountable chip inductor in accordance with the present invention will now be described in more detail with reference to the accompanying drawings.

Figure 1:
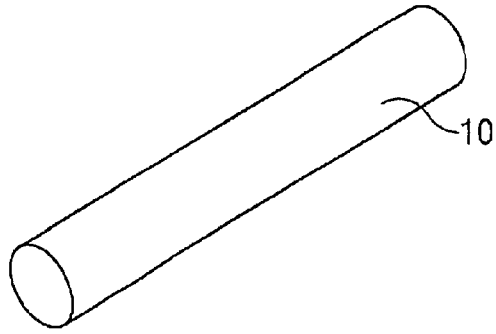
FIG. 1 illustrates a cylindrical body as a main body of inductor in accordance with the present invention.

FIG. 1 illustrates a cylindrical body 10 as an inductor main body used for a surface mountable chip inductor. The cylindrical body 10 is fabricated by mixing ferrite or ceramic powder with thermoplastic organic binder transformable by heating. A cylindrical shape can be formed by an extruding method, etc.

When ferrite is used in order to form the cylindrical body, it is preferable to use ferrite such as the group of Ni—Zn, the group of Cu—Zn, the group of Ni—Cu—Zn, etc. appropriate to high frequency.

An organic binder is generally added to the powder before a solid solution is formed by sintering of the powder, in order to form ferrite or ceramic powder into a certain shape and maintain the shape.

The organic binder in the present invention is used for transforming the cylindrical body 10 into a square-shaped body after forming a cylindrical body 10 and a spiral pattern on the surface of the body 10.

Accordingly, it is preferable to use thermoplastic resin such as PVA(polyvinylalcohl), PVB(polyvinylbutyral), polyethylene, polystyrene, polyvinylchloride, polyamide, etc. or its mixture as organic binder in order to make it appropriate to transform the cylindrical body 10 into a square-shape body at a certain temperature (for example, 300° C.), however organic binder is not limited to the above-mentioned materials and other materials can be used also.

In the meantime, because the added organic binder is made to disappear, i.e., removed, in the sintering process of the fabricated body, a solid sintered body that is constructed with ceramic or ferrite and various additives is obtained.

The first example for forming a spiral coil pattern on the surface of the cylindrical ceramic body will now be described.

Figure 2A:
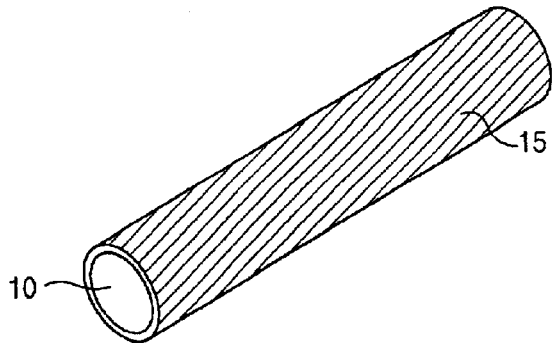
FIG. 2*a* illustrates a cylindrical body coated with a metal layer in accordance with a first example of the present invention.

First, as depicted in FIG. 2*a*, a metal layer 15 is coated on the surface of the cylindrical body 10. The metal layer can be coated so as to have a certain thickness by a surface treatment process such as dipping, plating, or sputtering, etc.

In the first example, the metal layer 15 is formed by coating Ag. However, as another example, other metal such as Al, Au, Pt, Ni, Cu, Pd, Sn or metal alloy including at least one of these can be used.

Figure 2B:
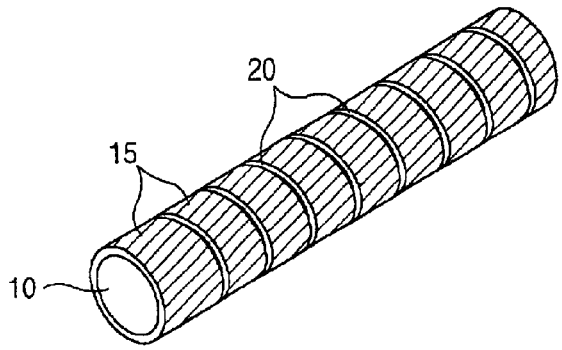
FIG. 2*b* illustrates a cylindrical body having a spiral pattern.

Next, as depicted in FIG. 2*b*, a spiral pattern is formed at the surface of the cylindrical body 10 having the metal layer 15. A spiral groove 20 is formed at the surface of the cylindrical body 10 by scanning laser on the metal layer 15. Accordingly, a coil pattern having a certain number of windings are formed at the surface of the cylindrical body 10. In forming of the coil pattern, any equipment can be used as long as it can process a fine groove as a spiral shape.

When a laser is used for processing the spiral groove 20, a depth or the number of windings the spiral groove 20 can be easily determined by adjusting a scanning power, a scanning time and a focal distance, etc. of the laser. For example, a depth of groove can be determined by a scanning power and a scanning time of laser, and a width of groove can be easily determined by adjusting a focal distance of laser. The spiral groove 20 can be processed by rotating the cylindrical body at a certain speed and at the same time reciprocating it back and forth while scanning laser. In this case, the interval between the grooves can be determined by a horizontal movement speed of the cylindrical body 10, a coil pattern having a certain number of windings can be formed on the cylindrical body 10 by adjusting the horizontal movement speed of the cylindrical body 10.

The spiral groove 20 can be formed more deeply than the thickness of the metal layer 15 so as to reach under the bottom of the metal layer 15 if needed.

The method for fabricating the spiral coil pattern in accordance with the second example of the present invention will now be described.

Figure 3A:
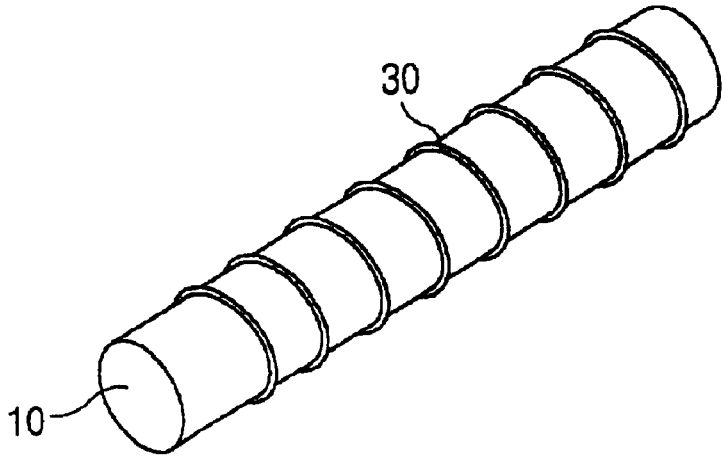
FIG. 3*a* illustrates a cylindrical body having a spiral metal coil pattern on a surface in accordance with a second example of the present invention.

As depicted in FIG. 3*a*, a spiral metal coil pattern is formed on the surface of the cylindrical body 10. In this case, it is preferable to fabricate a thread shaped flexible material 30 including conductive paste as the metal coil. The metal coil corresponds to an inductor coil. It is preferable to use Ag, Al, Au, Pt, Ni, Cu, Pd, Sn or metal alloy including one of the elements as the metal coil. In the method for fabricating the spiral coil pattern in accordance with the second example of the present invention, the spiral coil can be formed easier than the first example of the present invention which forms the spiral pattern after coating the metal layer.

Figure 3B:
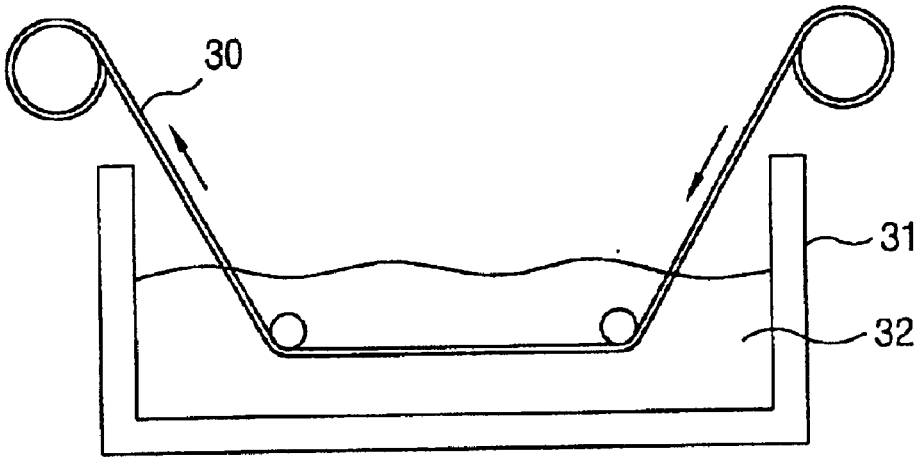
FIG. 3*b* illustrates a method for impregnating metal into a flexible material of the second example of the present invention.

As depicted in FIG. 3*b*, the thread-shaped flexible material 30 passes a container 31 containing conductive paste 32, such as metal paste, so that the paste 32 can infiltrate into the flexible material 30. It is preferable to use a combustible material as the flexible material in order for the material to be burnt in the sintering process.

As depicted in FIG. 3*a*, the flexible material 30 including the metal by passing the container is wound on the surface of the cylindrical body 10 as a spiral shape. In more detail, the flexible material 30 including metal is wound on the cylindrical body 10 with a certain interval while the cylindrical body 10 rotates centering around its axis and at the same time transfers in an axial direction at a certain speed. Besides, the spiral coil can be formed by fixing the cylindrical body 10 at a certain position, rotating it centering around an axis and winding the flexible material 30 on the body 10 with moving the material 30 to the direction of the axis. In order to harden the flexible material 30, the cylindrical body 10 including the spiral coil is left alone for a certain time.

The method for fabricating the spiral coil pattern will now be described in accordance with a third example of the present invention.

Figure 4:
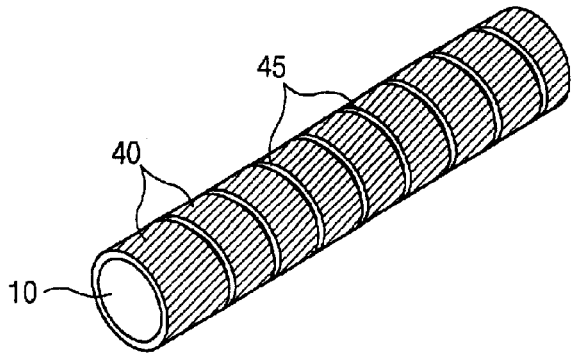
FIG. 4 illustrates a method for fabricating a spiral coil pattern in accordance with a third example of the present invention.

As depicted in FIG. 4, a tape 40 having a certain thickness and a certain width is wound on the outer circumference of the cylindrical body 10 as a spiral shape. An exposed portion 45 excluding the tape wound portion exists on the cylindrical body 10, conductive paste is coated on the exposed portion 45. Because the conductive paste is coated on the portion excluding the spiral tape wound portion, the conductive paste coated portion also has a spiral shape.

The interval between the metal coils is determined according to a width of the tape 40 wound on the outer circumference of the cylindrical body. In addition, a width of the metal coil formed on the outer circumference of the cylindrical body is determined by the interval between the tapes in the tape winding process. In addition, approximately the thickness of the metal coil can be determined by a thickness of tape itself. After forming the spiral metal coil on the outer circumference of the cylindrical body, the metal coil is hardened for a certain time.

The method for fabricating the spiral coil pattern will now be described in accordance with a fourth example of the present invention.

Figure 5A:
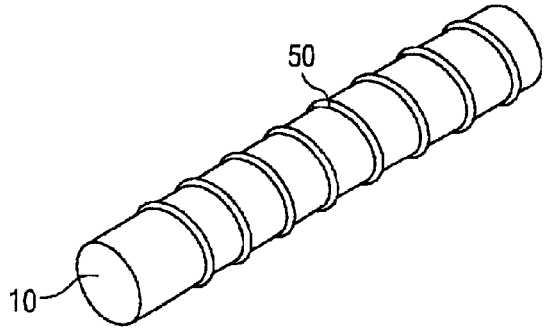
FIG. 5*a* illustrates a method for fabricating a spiral coil pattern in accordance with a fourth example of the present invention.
Figure 5B:
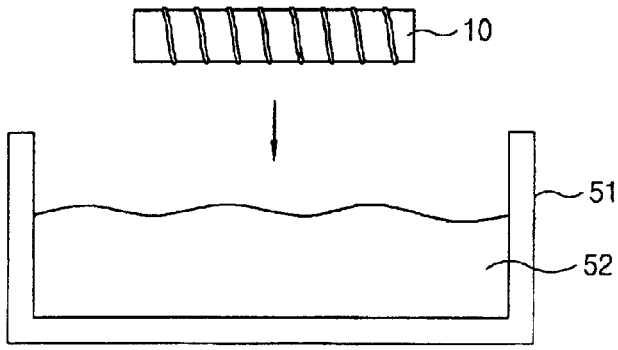
FIG. 5*b* illustrates a method for coating conductive paste on the outer circumference of a body in accordance with the fourth example of the present invention.

As depicted in FIG. 5*a*, a thread-shaped flexible material 50 is wound on the outer circumference of the cylindrical body 10 as a spiral shape having a certain interval. Herein, a material such as nylon, which cannot be infiltrated by conductive paste, is used as a flexible material. Next, as depicted in FIG. 5*b*, in order to coat conductive paste on the outer circumference of the cylindrical body, the cylindrical body 10 wound by the flexible material as a spiral shape is dipped in a container 51 containing conductive paste 52 for a certain time. And, the conductive paste coated on the cylindrical body 10 is hardened for a certain time. Because the conductive paste 52 does not impregnate into the flexible material, the conductive paste coated on the cylindrical body has a spiral shape. It is preferable to eliminate the flexible material from the cylindrical body 10, it is preferable for the conductive paste to have a coated thickness not greater than ½ of a diameter of the flexible material.

In the second, the third or the fourth example of the present invention, it is preferable to use a thread-shaped flexible material and tape for forming the spiral coil as a combustible material, also an incombustible material as a nonconductive material can be used. The cylindrical body having the spiral coil pattern according to above-described methods is transformed into a square-shaped body. Many methods can be used for that, in the preferred example of the present invention, the cylindrical body is inserted into a square-shaped mold and is pressed.

Figure 6A:
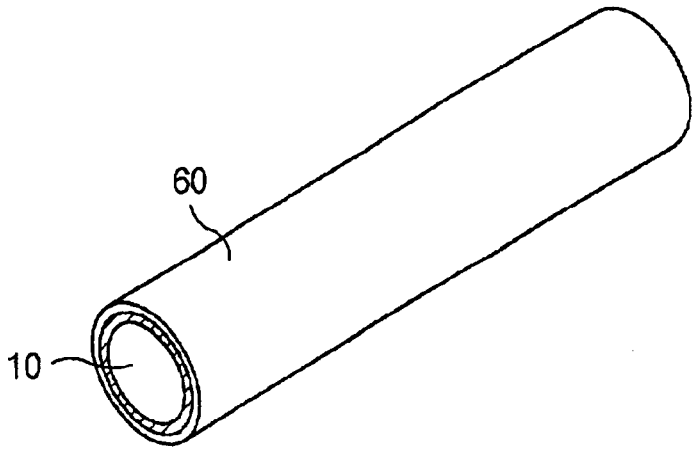
FIGS. 6*a* to 6*d* are flow charts illustrating a process transforming a cylindrical body into a square-shaped body.
Figure 6B:
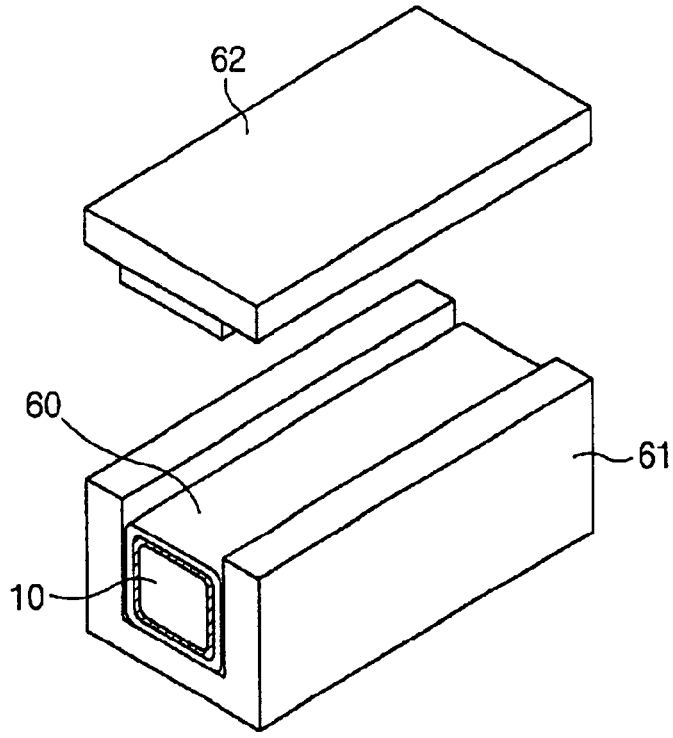
Figure 6C:
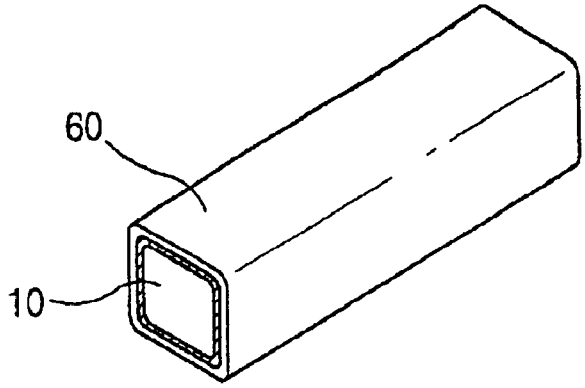

FIGS. 6*a*, 6*b* and 6*c* illustrate transforming the cylindrical body having the metal layer on the outer circumference into a square-shaped body. First, as depicted in FIG. 6*a*, an exterior coating layer 60 is formed on the outer circumference of the cylindrical body having the spiral coil. The exterior coating layer is formed so as to have a certain thickness by coating a compound of thermoplastic organic binder and ferrite or ceramic powder.

Next, as depicted in FIG. 6*b*. The cylindrical body is inserted into the square-shaped mold, is heated and pressed in order to transform it into a square shape. As shown in FIG. 6*b*, the mold is divided into a lower mold 61 and a upper mold 62. The lower mold 62 has a U shape because of a groove, the cylindrical body can be inserted through the upper portion. After inserting the cylindrical body, the upper mold 62 is combined with the lower mold 61.

In the present invention, because the mold has a square shape, also the transformed body has a square body. However, it is possible also to transform the body into a different shape according to types of surface mounting. The cylindrical body is transformed into a shape of mold by being pressed at a certain temperature inside the mold. Because the cylindrical body includes the thermoplastic organic binder, it can be transformed by heating and pressing process.

In the present invention, after coating the exterior coating layer on the cylindrical body, the cylindrical body is transformed into the square-shaped body. It is also possible to transform the cylindrical body into the square shape first and coat the exterior coating layer on the square-shaped body later.

Figure 6D:
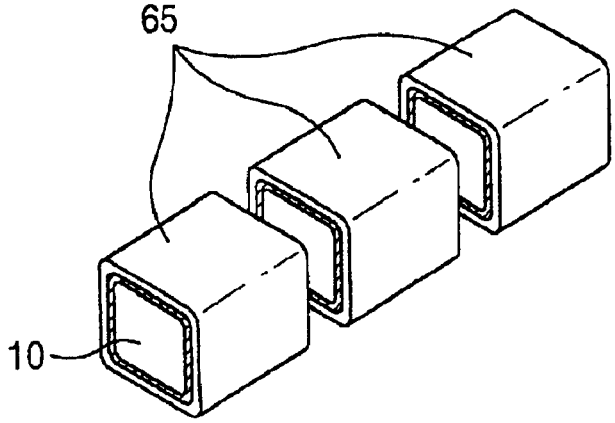

As depicted in FIG. 6*d*, the square-shaped body can be a single inductor 65 by being cut so as to have a certain length in case of needs. It is cut so as to have a general surface mountable size such as 1608, 2012, etc. By adjusting the size through the cutting, it can be surface mounted same as other stacked type part by the conventional chip mounter.

Figure 7A:
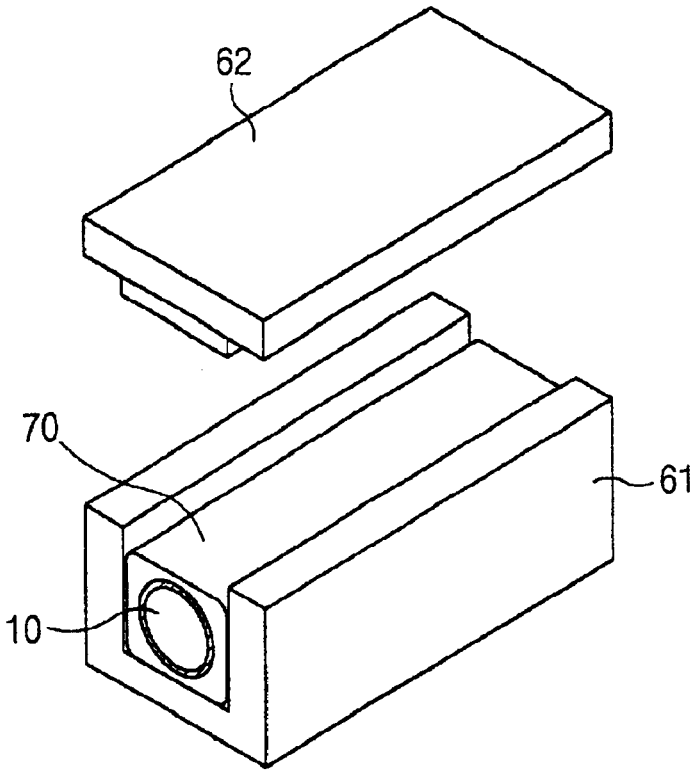

Another method for transforming the cylindrical body into a square-shaped body will now be described. It is the same method in including steps to heat and press the cylindrical body after inserting it into the square-shaped mold. One thing is different is that the cylindrical body is inserted into the mold without forming the exterior coating layer and an additional compound is supplied around the cylindrical body inside the mold in order to facilitate transformation into the square shape. FIG. 7*a* illustrates the cylindrical body 10 inside the mold and the compound 70 supplied around the cylindrical body 10 inserted into the mold.

As the compound 70, a mixture of ferrite or ceramic powder and organic binder, which are also used for forming the cylindrical body, is preferably used.

Figure 7B:
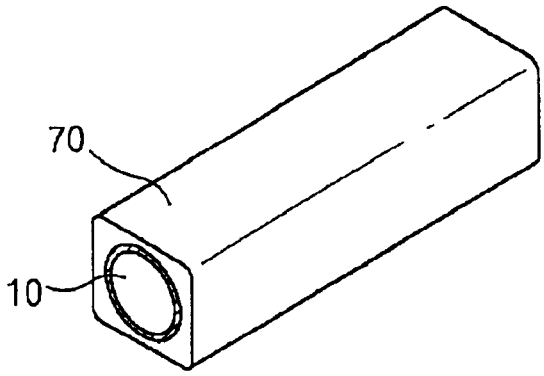
Figure 7C:
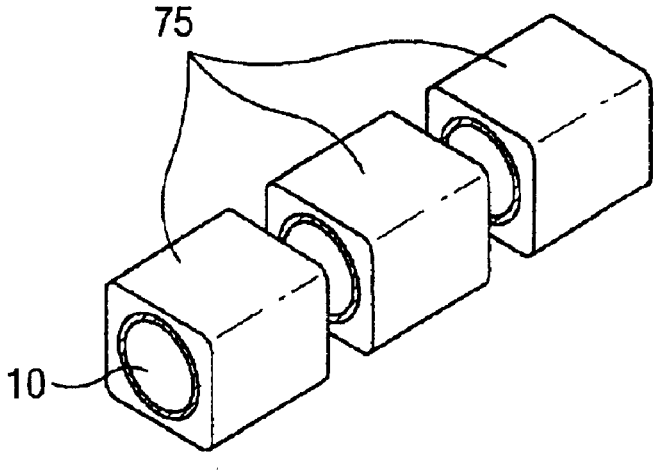

FIG. 7*b* illustrates the transformed square-shaped body inside the mold by the above-described method. As depicted in FIG. 7*c*, the transformed square-shaped body can be a single inductor 75 by being cut so as to have a certain length.

In the meantime, it is possible to press the cylindrical body so as to have the square shape with a square-shaped extruder besides the square-shaped mold.

Figure 8:
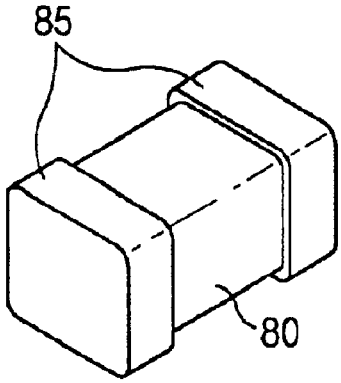
FIG. 8 illustrates a chip inductor having an external electrode at both ends in accordance with the present invention.

FIG. 8 illustrates a sintered body having an external electrode at both ends. Because the organic binder is vanished when the square-shaped body is sintered in the sintering process, the sintered body is constructed with ceramic or ferrite and various additives.

In accordance with the present invention, defects of the conventional wire wound type and stacked type inductor fabrication processes are compensated. By forming a coil pattern on a cylindrical body and transforming the cylindrical body into a square shaped body, an electric characteristic lowering problem is prevented. In addition, the simple process in the present invention is advantageous to mass production and lowers production cost. Further, a chip inductor in accordance with the present invention can be mounted easily using a conventional chip mounter.

What is claimed is:

1. A method for fabricating a surface mountable chip inductor, comprising:

forming a cylindrical body by mixing ferrite or ceramic powder with a thermoplastic organic binder;

forming a metal layer on the surface of the cylindrical body in a manner that forms a spiral coil pattern;

inserting the cylindrical body into a square-shaped mold; and applying pressure and heat to the mold to transform the cylindrical body into a square-shaped body.

2. The method of claim 1, wherein the metal layer includes at least one of Ag, Al, Au, Pt, Ni, Cu, Pd and Sn.

3. The method of claim 1, wherein the metal layer is fabricated on the surface of the cylindrical body by dipping, plating or sputtering so as to have a certain thickness.

4. The method of claim 1, wherein said coil pattern is fabricated by a laser process or a mechanical process.

5. The method of claim 1, wherein the coil pattern forming process comprises the steps of:

winding a thread-shaped flexible material including conductive paste on the surface of the cylindrical body; and hardening the conductive paste included in the flexible material.

6. The method of claim 5, wherein the thread-shaped flexible material is a combustible material which vanishes during sintering.

7. The method of claim 1, wherein the coil pattern forming process comprises the steps of:

winding a tape having a certain thickness and a width onto the surface of the cylindrical body in a spiral shape;

coating conductive paste on exposed portions of the cylindrical body between the wound tape; and hardening the coated conductive paste.

8. The method of claim 7, wherein the tape is a combustible material which vanishes during sintering.

9. The method of claim 1, wherein the coil pattern forming process comprises the steps of:

winding a thread-shaped flexible material free of conductive paste on the outer circumference of the cylindrical body in a spiral shape;

coating conductive paste on the outer circumference of the cylindrical body by dipping the cylindrical body in a container containing the conductive paste for a given time period; and hardening the coated conductive paste for given time period.

10. The method of claim 9, further comprising:

eliminating the flexible material from the cylindrical body.

11. The method of claim 1, wherein said application of heat comprises a sintering process and wherein the organic binder is a material that is removed during the sintering process.

12. The method of claim 11, wherein the organic binder includes at least one of PVA, PVB, polyethylene, polystyrene, polyvinylchloride and polyamide.

13. The method of claim 1, wherein a section of the square-shaped mold is a quadrangle.

14. The method of claim 1, further comprising:

forming an exterior coating layer on the cylindrical body using a mixture of ferrite or ceramic powder and thermoplastic organic binder after forming the spiral coil pattern on the surface of the cylindrical body.

15. The method of claim 1, further comprising:

supplying an additional mixture around the cylindrical body inside the square-shaped mold so as to form a square-shaped body after inserting the cylindrical body into the square-shaped mold.

16. The method of claim 15, wherein the additional mixture is the same material as the material used for forming the cylindrical body.

17. The method of claim 1, further comprising:

cutting the transformed square-shaped body to a certain length.

18. The method of claim 1, further comprising:

forming an external electrode on each end of the cylindrical body.

* * * * *